US007614851B2

(12) United States Patent
Lu et al.

(10) Patent No.: US 7,614,851 B2
(45) Date of Patent: Nov. 10, 2009

(54) CENTRIFUGAL FANS AND IMPELLERS THEREOF

(75) Inventors: Lobato Lu, Taoyuan Hsien (TW); Ke-Nan Wang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 383 days.

(21) Appl. No.: 11/593,114

(22) Filed: Nov. 6, 2006

(65) Prior Publication Data

US 2007/0110574 A1 May 17, 2007

(30) Foreign Application Priority Data

Nov. 11, 2005 (TW) ..... 94139633 A

(51) Int. Cl.
*F04D 29/28* (2006.01)

(52) U.S. Cl. ..... 416/186 R; 416/203; 29/889.4

(58) Field of Classification Search ..... 416/175, 416/203, 124, 223 B, 200 R, 198 R, 187, 416/178, 186 R, 2; 415/915; 29/889.4
See application file for complete search history.

(56) References Cited

U.S. PATENT DOCUMENTS 1,156,118 A * 10/1915 Warg ..... 416/178
3,285,187 A * 11/1966 Anderson, Jr ..... 416/186 R
5,013,215 A * 5/1991 Diehl ..... 416/178
5,611,668 A * 3/1997 Yapp et al. ..... 416/189
6,508,628 B2 * 1/2003 Amr ..... 416/189
7,390,163 B2 * 6/2008 Clauson ..... 416/175

* cited by examiner

*Primary Examiner*—Richard Edgar
(74) *Attorney, Agent, or Firm*—Birch, Stewart, Kolasch & Birch, LLP

(57) ABSTRACT

A centrifugal fan is provided. A hub covers a driving device. An impeller surrounds the hub and includes a first blade set and a second blade set. The first blade set surrounds the hub and includes a first combining portion, a second combining portion, and a plurality of first blades. The first and second combining portions are respectively connected to the first blades. The second blade set includes a third combining portion, a fourth combining portion, and a plurality of second blades. The third and fourth combining portions are respectively connected to the second blades. The first blade set is assembled with the second blade set by assembling the first combining portion with the third combining portion and assembling the second combining portion with the fourth combining portion.

18 Claims, 2 Drawing Sheets

100a

CENTRIFUGAL FANS AND IMPELLERS THEREOF

BACKGROUND OF THE INVENTION

1. Field of the Invention

The invention relates to centrifugal fans and impellers, and in particular to centrifugal fans and impellers with two centrifugal blade sets.

2. Description of the Related Art

Conventional centrifugal fans are often integrally formed by using a single mold. When the summation of the blades of an impeller of a centrifugal fan is increased, the thickness of each blade is reduced because of the required thickness of the mold. Thus, the blades are easily deformed or damaged during operation of the centrifugal fan. To maintain sufficient thickness of the blades, the thickness of the mold needs to be significantly reduced. The mold, however, is easily broken during formation of the blades.

Accordingly, the summation of the blades of the impeller of the centrifugal fan cannot be increased, such that wind pressure and wind volume provided by the centrifugal fan are limited. To increase the wind pressure and wind volume provided by the centrifugal fan, rotational speed thereof must be increased. However, noise generated by the centrifugal fan is increased according to the rotational speed. Moreover, as the blades of the impeller of the conventional centrifugal fan have the same shape, resonant noise is also generated during operation of the conventional centrifugal fan.

Hence, there is a need for centrifugal fans and impellers having more blades.

BRIEF SUMMARY OF THE INVENTION

A detailed description is given in the following embodiments with reference to the accompanying drawings.

The invention provides centrifugal fans and impellers with significantly reduced noise and increased wind pressure and wind volume during operation thereof.

An exemplary embodiment of the invention provides a centrifugal fan comprising a hub and an impeller. The hub covers a driving device. The impeller surrounds the hub and comprises a first blade set and a second blade set. The first blade set surrounds the hub and comprises a first combining portion, a second combining portion, and a plurality of first blades. The first and second combining portions are respectively connected to the first blades. The second blade set comprises a third combining portion, a fourth combining portion, and a plurality of second blades. The third and fourth combining portions are respectively connected to the second blades. The first and second combining portions respectively correspond to the third and fourth combining portions. The first blade set is assembled with the second blade set by assembling the first combining portion with the third combining portion and assembling the second combining portion with the fourth combining portion.

Another exemplary embodiment of the invention provides an impeller comprising a first blade set and a second blade set. The first blade set comprises a first combining portion, a second combining portion, and a plurality of first blades. The first and second combining portions are respectively connected to the first blades. The second blade set comprises a third combining portion, a fourth combining portion, and a plurality of second blades. The third and fourth combining portions are respectively connected to the second blades. The first and second combining portions respectively correspond to the third and fourth combining portions. The first blade set is assembled with the second blade set by assembling the first combining portion with the third combining portion and assembling the second combining portion with the fourth combining portion.

In the aforementioned centrifugal fan or impeller, the type of each first blade is different from or the same as that of each second blade. The first and second blades are formed with different inclined angles. The size of each first blade is different from that of each second blade. The first blades are parallel or not parallel to the second blades. The first and second blades are alternately arranged or serially arranged. The first and second blades comprise centrifugal blades.

In the aforementioned centrifugal fan or impeller, the third combining portion is a top cover. The first and third combining portions respectively comprise a first fixing portion and a second fixing portion corresponding thereto. The first and second fixing portions are respectively a protrusion and a recess, engaging structure, or embedding structure. The second and fourth combining portions respectively comprise a third fixing portion and a fourth fixing portion corresponding thereto. The third and fourth fixing portions are respectively a protrusion and a recess, engaging structure, or embedding structure.

In the aforementioned centrifugal fan or impeller, the first blade set is integrally formed with the hub as a single piece. The first blade set is detachably connected to the second blade set. The summation of the total blades of the impeller is more than 20.

The centrifugal fan or impeller further comprises at least one third blade set comprising a fifth combining portion, a sixth combining portion, and at least one third blade. The fifth and sixth combining portions are respectively connected to the third blade. The third blade is assembled with the impeller by the fifth and sixth combining portions.

In the aforementioned centrifugal fan or impeller, as the impeller is composed of at least two blade sets, insufficient thickness of the blades or a mold is not raised during formation of the impeller, such that the summation of the total blades of the impeller is increased and enhanced wind pressure and wind volume provided during operation thereof.

In the aforementioned centrifugal fan or impeller, as the impeller can comprise blades with two or more than two types, resonant noise is not generated during operation thereof. Noise generated by the centrifugal fan or impeller is thus reduced.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
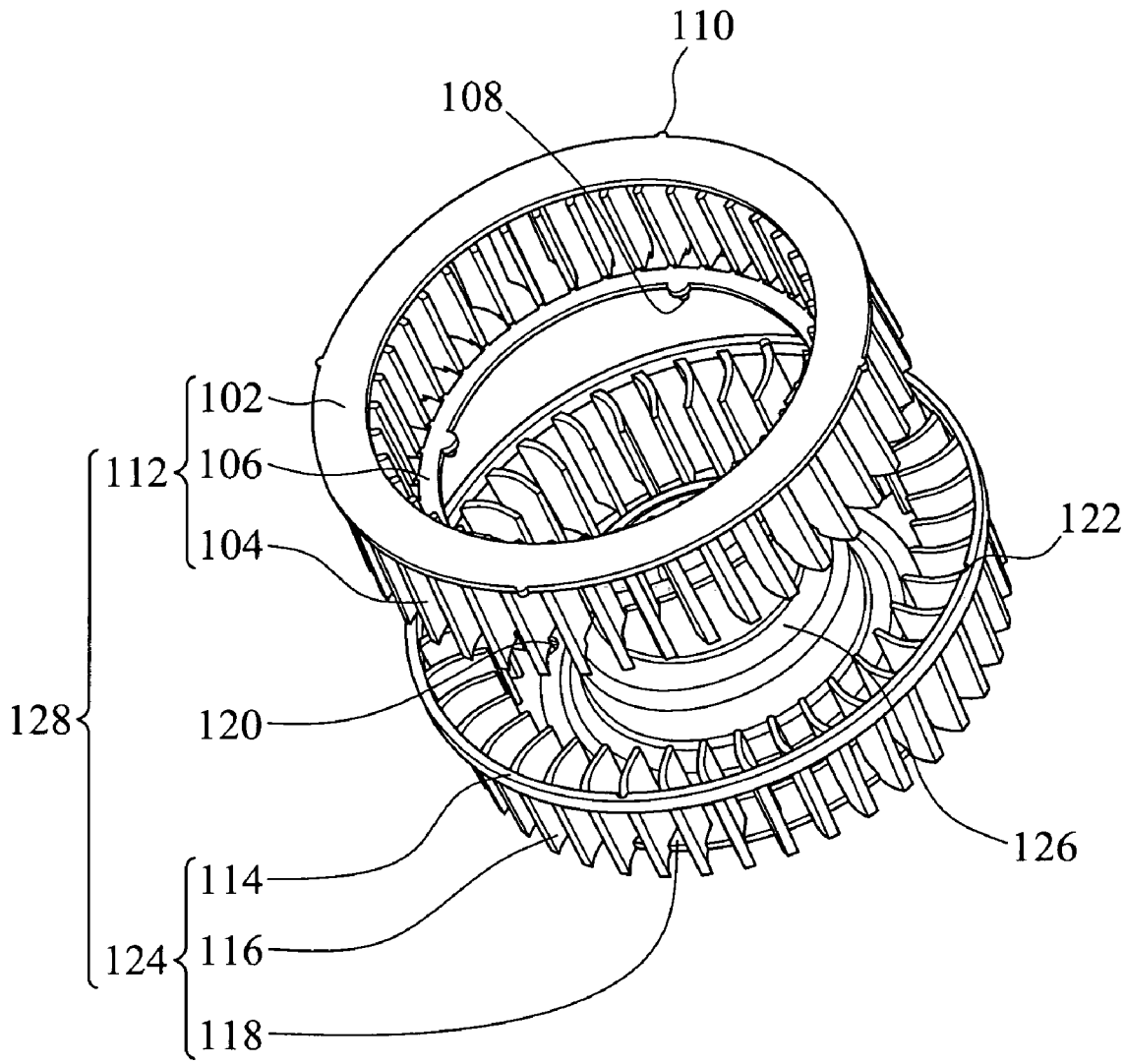
FIG. 1 is a schematic exploded view of a centrifugal fan of an embodiment of the invention.

FIG. 1 is a schematic exploded view of a centrifugal fan 100 of an embodiment of the invention. The centrifugal fan 100 comprises a hub 126 and an impeller 128. The hub 126 covers a driving device (not shown) and the driving device drives the fan to rotate. The hub 126 may be cylindrical or tubular.

The impeller 128 surrounds the hub 126 and comprises a first blade set 124 and at least one second blade set 112. The first blade set 124 surrounds the hub 126 and comprises a first combining portion 114, a second combining portion 118, and a plurality of first blades 116. The first combining portion 114 and second combining portion 118 are respectively connected to each first blade 116. Specifically, the first combining portion 114 and second combining portion 118 can be respectively connected to the top and bottom of each first blade 116. The first combining portion 114 and second combining portion 118 may be rib-like or annular. Moreover, the first combining portion 114 and second combining portion 118 respectively comprise at least one first fixing portion 122 and at least one third fixing portion 120. The first fixing portion 122 and third fixing portion 120 may be protrusions, recesses, or engaging or embedding structure. The first blade set 124 is integrally formed with the hub 126. The first blades 116 may be centrifugal blades.

The second blade set 112 comprises a third combining portion 102, a fourth combining portion 106, and a plurality of second blades 104. The third combining portion 102 and fourth combining portion 106 are connected to each second blade 104 and correspond to first combining portion 114 and second combining portion 118 of the first blade set 124, respectively. Specifically, the third combining portion 102 and fourth combining portion 106 are respectively connected to the top and bottom of each second blade 104. The third combining portion 102 and fourth combining portion 106 may be rib-like or annular. The third combining portion 102 can be a top cover of the impeller 128 or centrifugal fan 100. Moreover, the third combining portion 102 and fourth combining portion 106 respectively comprise at least one second fixing portion 110 and at least one fourth fixing portion 108. The second fixing portion 110 and fourth fixing portion 108 may be protrusions, recesses, or engaging or embedding structure. Specifically, the second fixing portion 110 and fourth fixing portion 108 of the second blade set 112 respectively correspond to the first fixing portion 122 and third fixing portion 120 of the first blade set 124. The second blade set 112 is detachably connected to the first blade set 124. The second blades 104 may be centrifugal blades.

The second blade set 112 is assembled with the first blade set 124 by assembling the first combining portion 114 with the third combining portion 102 and assembling the second combining portion 118 with the fourth combining portion 106. Accordingly, the second blade set 112 and first blade set 124 can be easily positioned and assembled, obtaining sufficient assembled strength. Further, the second blade set 112 can be assembled with the first blade set 124 by only assembling the first combining portion 114 with the third combining portion 102 or only assembling the second combining portion 118 with the fourth combining portion 106.

The type of each second blade 104 may be the same as or different from that of each first blade 116. The second blades 104 and first blades 116 may be formed with different inclined angles or the same inclined angles. The size of each second blade 104 may be the same as or different from that of each first blade 116. The second blades 104 may be parallel or non-parallel to the first blades 116. When the second blades 104 are non-parallel to the first blades 116, at least one of the second blades 104 does not contact the first blades 116. The second blades 104 and first blades 116 may be alternately arranged or serially arranged. The second blades 104 and first blades 116 may surround the circumference of the hub 126 in the form of a single ring.

The summation of the second blades 104 and first blades 116 is more than 20, preferably more than 25, and more preferably more than 30.

Figure 2:
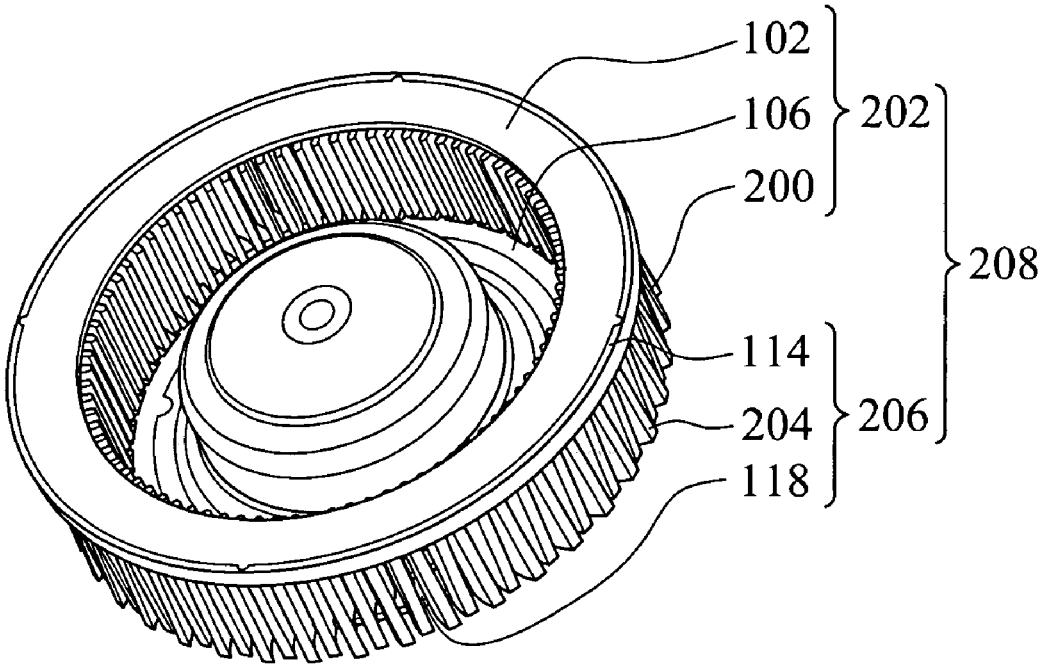
FIG. 2 is a schematic assembly view of a centrifugal fan of another embodiment of the invention.

FIG. 2 is a schematic assembly view of a centrifugal fan 100*a* of another embodiment of the invention. An impeller 208 of the centrifugal fan 100*a* comprises a first blade set 202 and a second blade set 206. The type of the blades 200 of the first blade set 202 and the type of the blades 204 of the second blade set 206 are different. Compared to the impeller 128 forming by the same blades, the impeller 208 comprising the different type of blades does not generate resonant noise. Thus, noise generated by operation of the centrifugal fan 100*a* is less than that of the centrifugal fan 100.

The disclosed impellers are not limited to two blade sets. Namely, the impellers of the invention may have multiple first and second blade sets.

As the disclosed impellers comprise at least two blade sets, insufficient thickness of the blades or a mold is not raised during formation of the impellers, such that the summation of the total blades of the impellers can be increased and enhanced wind pressure and volume provided during operation thereof.

Moreover, as the disclosed impeller comprises the blades with more than two types resonant noise is not generated during operation thereof. Noise generated by the disclosed centrifugal fan or impeller is thus reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A centrifugal fan, providing an air-inflow and an air-outflow in different directions, comprising:

a hub covering a driving device; and an impeller surrounding the hub and rotated together with the hub, comprising:

a first blade set surrounding the hub and comprising a first combining portion and a plurality of first blades, wherein the first combining portion is connected to the first blades; and a second blade set comprising a second combining portion and a plurality of second blades, wherein the second combining portion is connected to the second blades;

wherein the first blade set is assembled with the second blade set by assembling the first combining portion with the second combining portion, and each of the second blades is located between two of the first blades.

2. The centrifugal fan as claimed in claim 1, wherein the first blades and the second blades have different types, different inclined angles, or different sizes.

3. A centrifugal fan, providing an air-inflow and an air-outflow in different directions, comprising:

a hub covering a driving device driving the fan to rotate; and an impeller surrounding the hub and rotated together with the hub, comprising:

a first blade set surrounding the hub and comprising a first combining portion, a second combining portion, and a plurality of first blades, wherein the first and second combining portions are respectively connected to the first blades; and a second blade set comprising a third combining portion, a fourth combining portion, and a plurality of second blades, wherein the third and fourth combining portions are respectively connected to the second blades;

wherein the first blade set is assembled with the second blade set by assembling the first combining portion with the third combining portion and assembling the second combining portion with the fourth combining portion, and each of the second blades is located between two of the first blades.

4. The centrifugal fan as claimed in claim 3, wherein the first blades and the second blades have different types, different inclined angles, or different sizes.

5. The centrifugal fan as claimed in claim 3, wherein the first and second blades are alternately arranged, serially arranged, parallel, or non-parallel.

6. The centrifugal fan as claimed in claim 3, wherein the third combining portion is a top cover.

7. The centrifugal fan as claimed in claim 3, wherein the first and third combining portions respectively comprise a first fixing portion and a second fixing portion corresponding thereto, or the second and fourth combining portions respectively comprise a third fixing portion and a fourth fixing portion corresponding thereto.

8. The centrifugal fan as claimed in claim 7, wherein the first, second, third or fourth fixing portion is a protrusion, a recess, engaging structure, or embedding structure.

9. The centrifugal fan as claimed in claim 3, wherein the first blade set is integrally formed with the hub as a single piece.

10. The centrifugal fan as claimed in claim 3, wherein the first blade set is detachably connected to the second blade set.

11. The centrifugal fan as claimed in claim 3, wherein the first blades and the second blades have the same type, the same inclined angle, or the same size.

12. The centrifugal fan as claimed in claim 3, wherein the summation of the first and second blades of the impeller is more than 20.

13. An impeller, rotated together with a hub in a centrifugal fan which provides an air-inflow and an air-outflow in different directions, comprising:

a first blade set comprising a first combining portion, a second combining portion, and a plurality of first blades, wherein the first and second combining portions are respectively connected to the first blades; and a second blade set comprising a third combining portion, a fourth combining portion, and a plurality of second blades, wherein the third and fourth combining portions are respectively connected to the second blades;

wherein the first blade set is assembled with the second blade set by assembling the first combining portion with the third combining portion and assembling the second combining portion with the fourth combining portion, and each of the second blades is located between two of the first blades.

14. The impeller as claimed in claim 13, wherein the first blades and the second blades have different types, different inclined angles, or different sizes.

15. The impeller as claimed in claim 13, wherein the third combining portion is a top cover.

16. The impeller as claimed in claim 13, wherein the first and third combining portions respectively comprise a first fixing portion and a second fixing portion corresponding thereto, or the second and fourth combining portions respectively comprise a third fixing portion and a fourth fixing portion corresponding thereto.

17. The impeller as claimed in claim 16, wherein the first, second, third or fourth fixing portion is a protrusion, a recess, engaging structure, or embedding structure.

18. The impeller as claimed in claim 13, wherein the summation of the first and second blades of the impeller is more than 20.

* * * * *